US005519594A

United States Patent [19]

Wu

[11] Patent Number: 5,519,594

[45] Date of Patent: May 21, 1996

[54] LAMPSHADE STRUCTURE OF A HALOGEN LAMP

[76] Inventor: Wen-Chang Wu, No. 132-2, Hsi-Hsin Street, Chuang Ya Village, Shiushui Hsiang, Chang Hua County, Taiwan

[21] Appl. No.: 447,945

[22] Filed: May 23, 1995

[51] Int. Cl.[6] ..... F21S 3/00

[52] U.S. Cl. ..... 362/223; 362/226; 362/310; 362/311; 362/375; 362/307

[58] Field of Search ..... 362/217, 220, 362/223, 221, 226, 353, 263, 310, 311, 374, 375, 396, 307, 433, 437, 439, 455, 448; 439/232, 239, 240, 241

[56] References Cited

U.S. PATENT DOCUMENTS

| | | | |
|---|---|---|---|
| 2,988,634 | 6/1961 | Miskella | 439/239 X |
| 3,436,716 | 4/1969 | Amis, Jr. et al. | 439/232 |
| 4,247,884 | 1/1981 | McJunkin, Jr. et al. | 362/223 |
| 4,282,564 | 8/1981 | McJunkin, Jr. et al. | 362/223 |
| 4,300,187 | 1/1981 | Fletcher | 362/223 |
| 4,315,302 | 2/1982 | Petralia | 362/226 |
| 5,093,767 | 3/1992 | Burn | 362/217 |

*Primary Examiner*—Denise L. Gromada
*Assistant Examiner*—Thomas M. Sember

[57] ABSTRACT

A lampshade structure of halogen lamp contains a lampshade, an inner aluminum casing, a rod-shaped lamp, a glass casing and two pressing plates. The inner chamber of the lampshade is made of metal. Two sockets with corresponding rectangular recesses are disposed in the lampshade. The pressing plate which has an incurved plate to connect the lampshade and an outcurved plate to press and fasten the glass casing tightly. The aluminum casing is inserted into the recesses of the sockets. The lamp which is inserted into the sockets is enclosed by the aluminum casing and the glass casing.

3 Claims, 4 Drawing Sheets

FIG 1 PRIOR

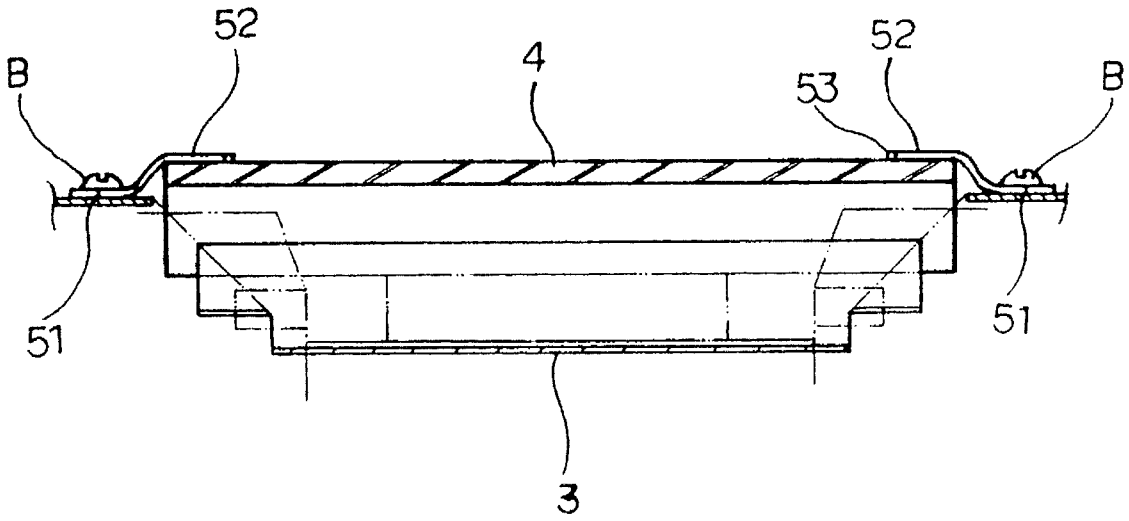
FIG 3-B
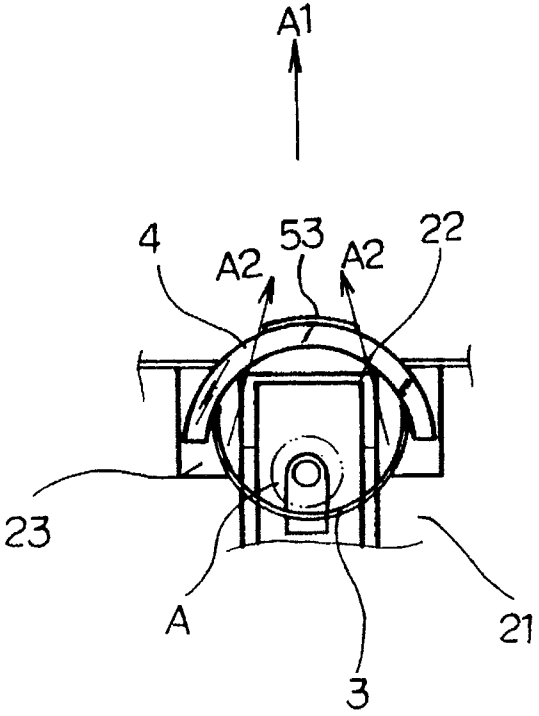
FIG 3-A

LAMPSHADE STRUCTURE OF A HALOGEN LAMP

BACKGROUND OF THE INVENTION

1. Field of the Invention

The present invention relates to a halogen lamp, and more particulary to a lampshade sturcture of an halogen lamp.

2. Description of the Prior Art

Referring to FIG. 1, a conventional halogen lamp has a rod 1, a lampshade 2 and a rod-shaped bulb A. The lampshade 2 which is made of aluminum has an inner chamber 21. Two sockets 22 are disposed in the lampshade in order to receive two corresponding ends of the bulb A. Each socket 22 has a socket groove 221 to receive the end of the bulb A. However, the conventional halogen lamp has the following disadvantages. The reflective light is easily dispersed. The chamber 21 will cause reflective corona and reflective surface. The ray which forwards to the periphery of the inner chamber 21 forms indirective reflection on the reflective corona and reflective surface. Thus the light is dispersed and becomes astigmatic. Further, the reflective light will cause violet ray damage. The violet ray may cause skin cancer and other skin diseases.

SUMMARY OF THE INVENTION

The object of the invention is to provide a lampshade sturcture of halogen lamp which contains an upper glass casing and an aluminum casing to increase concentrated reflection and brightness.

Another object of the invention is to provide a lampshade sturcture of halogen lamp which contains a glass casing to block violet ray produced by the halogen lamp.

Another object of the invention is to provide a lampshade sturcture of halogen lamp which contains metal pressing plate to fasten the glass casing fixedly.

In accordance with one aspect of the invention is to provide a lampshade structure of halogen lamp comprises a lampshade with an inner chamber which is made of metal, an aluminum casing disposed in the lampshade, a glass casing covering the aluminum casing, a rod-shaped lamp enclosed by the glass casing and the aluminum casing, two sockets which have corresponding rectangular recesses therein being disposed in an inner peiphery of the lampshade, each upper edge of the socket having a screw hole, two pressing plates which have an outer plate to connect the lampshade and an inner plate to press and fasten an end of the glass casing, two ends of the aluminum casing being inserted into the rectangular recesses, two ends of the rod-shaped lamp being inserted into the corresponding sockets.

Further objectives and advantage of the present invention will become apparent from a careful reading of a detailed description provided hereinbelow, with appropriate reference to accompanying drawings.

BRIEF DESCRIPTION OF THE DRAWINGS

FIG. 3A is a partially schematic view of FIG. 2, and

FIG. 3B is an end plan view of FIG. 2.

DETAILED DESCRIPTION OF THE INVENTION

Figure 1:
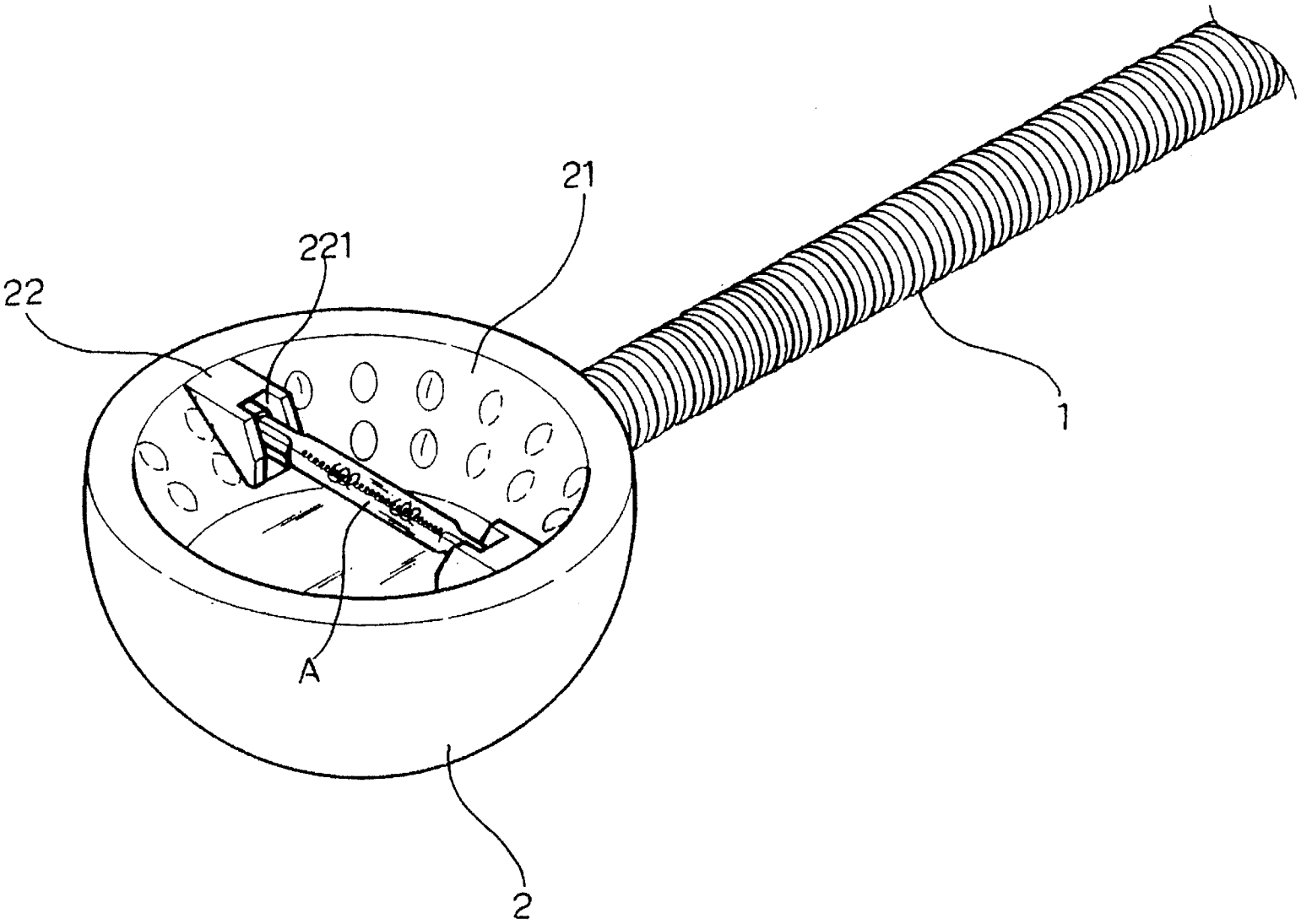
FIG. 1 is an assembly perspective view of a conventional halogen lamp of the prior art.
Figure 2:
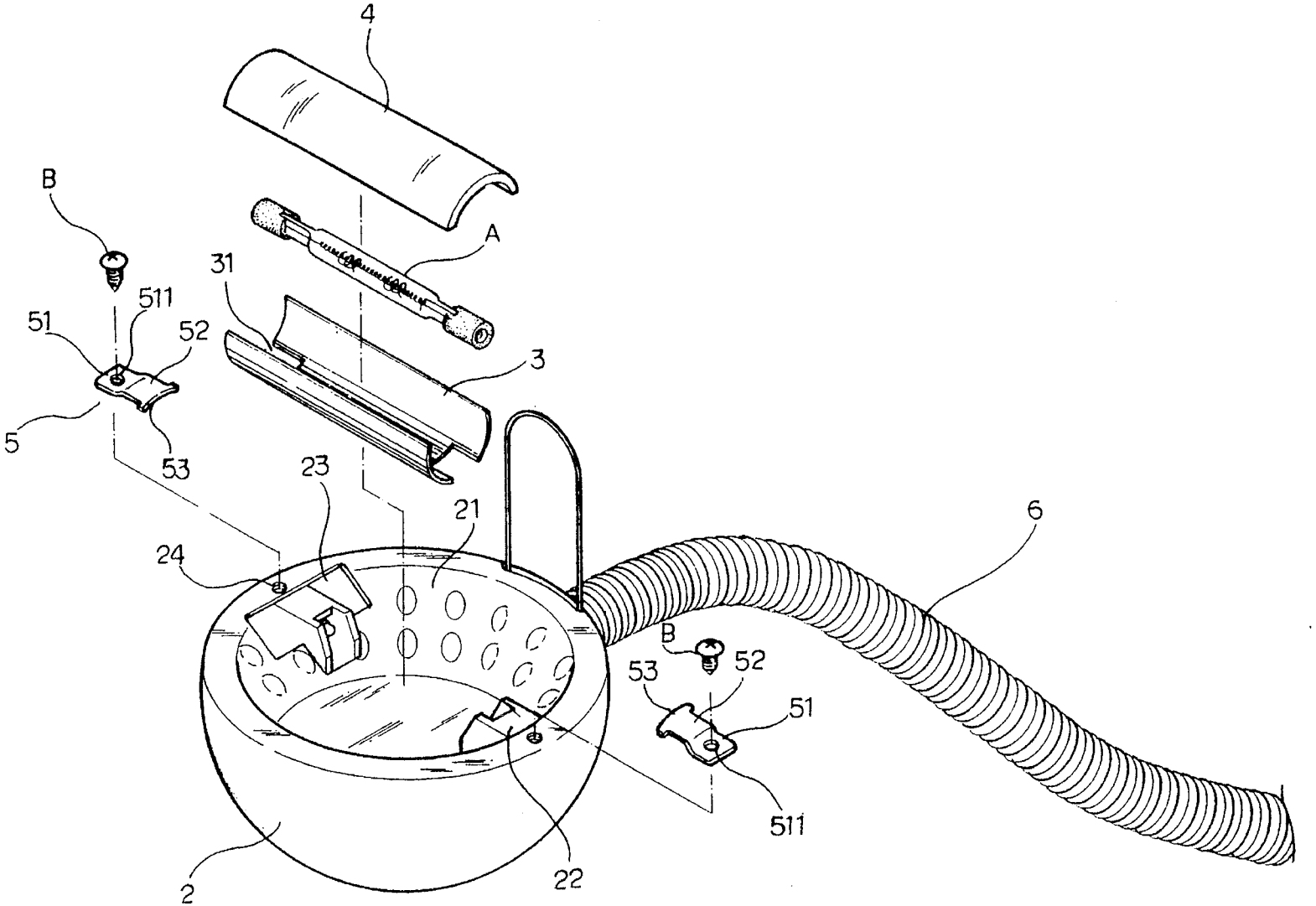
FIG. 2 is a perspective exploded view of a perferred embodiment in accordance with the invention.
Figure 3:
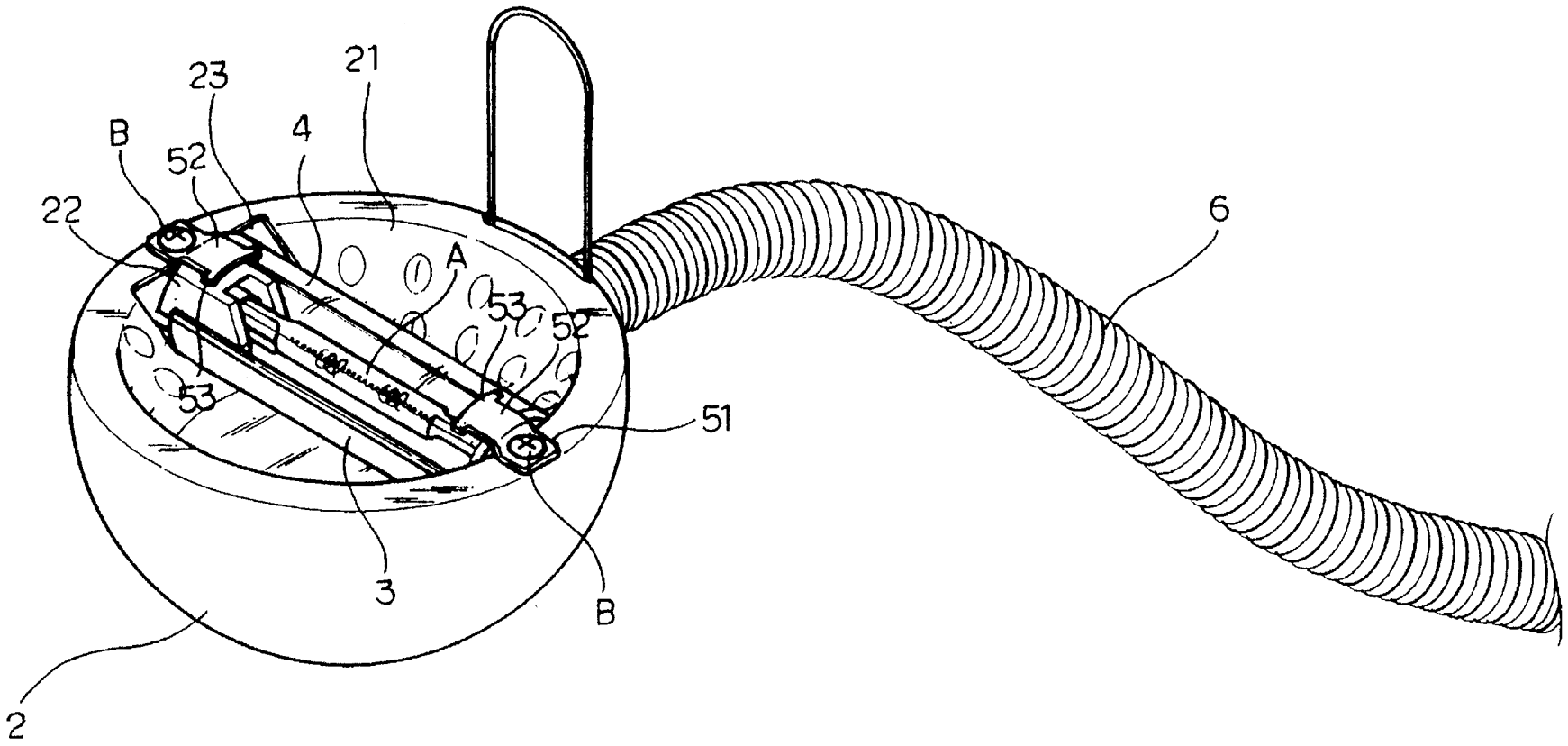
FIG. 3 is an assembly perspective view of FIG. 2.

Referring to FIGS. 2, 3, 3A and 3B, a lampshade structure of halogen lamp contains a lampshade 2, an inner aluminum casing 3, a rod-shaped lamp A, a glass casing 4 and two pressing plates 5. A flexible rod 6 connects to the back of the lampshade 2. The inner chamber 21 of the lampshade 2 is made of metal. Two sockets 22 which have corresponding rectangular recesses 23 are disposed in the inner periphery of the inner periphery of the inner chamber 21. The upper edge of the socket 22 has a screw hole 24. The incurved aluminum casing 3 has two rectangular recesses 31 at two ends. The outcurved glass casing 4 is transparent. Thhe pressing plate 5 has an incurved plate 51 as the outer portion and an outcurved plate 52 as the inner portion. The incurved plate 51 has a central hole 511. The end edge of the outcurved plate 52 is a ductile pressing plate 53.

The two ends of the aluminum casing 3 are inserted in to the recesses 23 of sockets 22. The two ends of the rod-shaped lamp A are inserted into the two sockets 22. The lamp A are enclosed by the aluminum casing 3 and the glass casing 4. The two ends of the glass casing 4 are pressed by two pressing plates 5. While the screw B is tight, the incurved plate 5 is fastened via the screw B and the screw hole 24. Then the glass casing 4 and the aluminum casing 3 are restricted tightly. While the lamp A is lighted, the directive projected light A1 and the reflective light A2 via the aluminum casing 3 are parallel and concentrated. The violet rays of the light A1 and A2 are blocked by the glass casing 4.

Although this invention has been described with a certain degree of particularity, it is to be understood that the present disclosure has been made by way of example only and that numerous change in the detailed construction and the combination and arrangement of parts may be resorted to without departing from the spirit and scope of the invention as hereinafter claimed.

What is claimed is:

1. A lampshade structure of a halogen lamp comprising:

a lampshade with an inner chamber which is made of metal;

an aluminum casing disposed in said lampshade;

a glass casing covering said aluminum casing;

a rod-shaped lamp enclosed by said glass casing and said aluminum casing;

two sockets which have corresponding rectangular recesses therein being disposed in an inner peiphery of said lampshade;

each socket having an upper edge, said upper edge having a screw hole;

two pressing plates, each pressing plate having an outer plate portion to connect said lampshade and an inner plate portion to press and fasten an end of said glass casing;

each outer plate portion having a central hole to be inserted by a screw, said screw passing through central hole to connect one of the upper edge screw holes;

said aluminum casing having two ends being inserted into said rectangular recesses;

two ends of said rod-shaped lamp having two ends being inserted into said corresponding sockets.

2. A lampshade structure of halogen lamp as claimed in claim 1, wherein said inner plate portion is an outcurved plate in order to press said glass casing tightly.

3. A lampshade structure of halogen lamp as claimed in claim 1, wherein said outer plate portion is an incurved plate.

* * * * *